US008590234B2

(12) United States Patent
Groft

(10) Patent No.: US 8,590,234 B2
(45) Date of Patent: Nov. 26, 2013

(54) INSULATED ROOF ASSEMBLY

(75) Inventor: Veronica Groft, Littlestown, PA (US)

(73) Assignee: Environmentally Safe Products, Inc., New Oxford, PA (US)

( * ) Notice: Subject to any disclaimer, the term of this patent is extended or adjusted under 35 U.S.C. 154(b) by 329 days.

(21) Appl. No.: 12/667,729

(22) PCT Filed: Aug. 22, 2008

(86) PCT No.: PCT/US2008/074031

§ 371 (c)(1),
(2), (4) Date: Dec. 22, 2010

(87) PCT Pub. No.: WO2009/026525

PCT Pub. Date: Feb. 26, 2009

(65) Prior Publication Data

US 2011/0094175 A1 Apr. 28, 2011

Related U.S. Application Data

(60) Provisional application No. 60/935,620, filed on Aug. 22, 2007.

(51) Int. Cl.
*E04B 1/70* (2006.01)

(52) U.S. Cl.
USPC ..... 52/302.1; 52/798.1

(58) Field of Classification Search
USPC ..... 52/198, 199, 404.1, 404.3, 404.5, 52/407.1–407.4, 407.5, 309.4, 309.8, 52/309.9
See application file for complete search history.

(56) References Cited

U.S. PATENT DOCUMENTS

| | | | | | |
|---|---|---|---|---|---|
| 4,014,150 | A | * | 3/1977 | Wells et al. | 52/461 |
| 4,058,949 | A | * | 11/1977 | Bellem | 52/407.1 |
| 4,263,763 | A | * | 4/1981 | Bouwens | 52/404.3 |
| 4,346,543 | A | * | 8/1982 | Wilson et al. | 52/404.2 |
| 4,375,741 | A | * | 3/1983 | Paliwoda | 52/127.1 |
| 4,434,601 | A | * | 3/1984 | Zellmer | 52/745.13 |
| 4,566,239 | A | * | 1/1986 | Smigel et al. | 52/407.4 |
| 4,642,961 | A | * | 2/1987 | Cruise | 52/408 |
| 4,843,774 | A | * | 7/1989 | Korsgaard | 52/408 |
| 5,085,023 | A | * | 2/1992 | Duffy | 52/410 |
| 5,316,835 | A | | 5/1994 | Groft et al. | |
| 5,561,959 | A | * | 10/1996 | Alderman et al. | 52/407.3 |
| 7,818,922 | B2 | * | 10/2010 | Ellis | 52/95 |
| 8,156,703 | B2 | * | 4/2012 | Alderman | 52/309.13 |

FOREIGN PATENT DOCUMENTS

| | | |
|---|---|---|
| EP | 1 715 111 A1 | 10/2006 |
| GB | 2 405 415 | 3/2005 |
| WO | 95/12724 | 5/1995 |

OTHER PUBLICATIONS

International Search Report for PCT/US2008/074031 dated Nov. 19, 2008.

* cited by examiner

*Primary Examiner* — William Gilbert
*Assistant Examiner* — Gisele Ford
(74) *Attorney, Agent, or Firm* — Nixon Peabody LLP

(57) ABSTRACT

An insulated roof assembly includes at least one support structure having a main body portion, a first insulation material generally disposed around the main body portion and a roof panel supported by the at least one support structure. A second insulation material is disposed between the roof panel and the at least one support structure. A third insulation material is disposed between the second insulating material and the at least one support structure. Thus, in a final assembly, the third insulating material is disposed a first distance apart from the roof panel and a second distance apart from the first insulation material.

28 Claims, 4 Drawing Sheets

INSULATED ROOF ASSEMBLY

CROSS REFERENCE TO RELATED DOCUMENTS

This application claims priority to provisional patent application No. 60/935,620 entitled "Insulated Roof Assembly," filed Aug. 22, 2007, the entire disclosure of which is hereby incorporated by reference herein.

BACKGROUND OF THE INVENTION

1. Field of the Invention

The present invention is directed to a roof assembly for a building which is provided with insulation.

2. Description of Related Art

Presently, in the metal building industry, two main energy conservation code and guidelines are followed by most metal building erectors. First is the International Energy Conservation Code (IECC) and second is the Standard 90.1 promulgated by the American Society of Heating, Refrigerating and Air Conditioning Engineers (ASHRAE). Both of these standards seek to encourage energy efficiency in the metal building industry for environmental benefit, and the benefit of the users of such metal buildings through the resultant energy cost savings.

These standards, and the United States Department of Energy (DOE), set forth the desired U-factor values for metal buildings. These values are set to increase approximately 30% over the next three years. The current approved standard for most non-residential metal buildings in roofs and ceilings is U-0.065 (R-15.38) which is 6" Faced Fiberglass installed over and perpendicular to the purlins. This increase will improve the current approval standard to U-0.055 (R-18.2) or U-0.049 (R-20.4) for most ASHRAE climate zones. The U-factor is the inverse, or reciprocal, of the total R-Value, i.e.: U-factor=1/Total R-Value. The R-Value is the thermal resistance to heat flow. A larger R-Value means that the material has greater thermal resistance and more insulating ability as compared to a smaller R-Value. Such R-Values can be added together. For instance, for homogeneous assemblies, the total R-Value of an insulation assembly is the sum of the R-Value of each layer of insulation. These layers may include sheathing and finishes, the insulation itself, air films and weatherproofing elements.

Presently, conventional insulation material that is used in the metal building industry is 6 inches thick, faced fiberglass insulation bans, which have an R-19 rating. FIG. 1 shows a conventional insulated roof assembly 1 for a metal building which has been assembled in accordance with IECC Metal Building Assembly requirements. As can be seen, a standing seam 3 with fiberglass insulation 5 is provided. Thermal blocks 7 are R-5 rigid insulation materials which are supported on purlin 9, purlin 9 being the structural members that support the standing seam roof clip 6 and the roof panel 2. Correspondingly, the R-19 fiberglass insulation 5 is draped perpendicularly across the purlins 9. The thermal blocks 7 are then placed above the purlin/insulation, and the standing seam roof clip 6 is secured to the purlins 9, the roof panel 2 being secured to the standing seam roof clip 6. However, when such faced fiberglass insulation is installed in metal buildings as required by the IECC, the actual measured R-Value is substantially less. In this regard according to the North American Insulation Manufacturers Association (NAIMA), for faced fiberglass insulation 5 that are approximately 6 inches thick, U-0.065 and R-15.38 was measured which does not meet the noted standards of U-0.055 or U-0.049.

Therefore, there exists an unfulfilled need for an insulated roof assembly that can meet the increased IECC and ASHRAE Standards for metal buildings without the need for a drastic change in current building practices.

SUMMARY OF THE INVENTION

In accordance with an embodiment of the present invention, an insulated roof assembly includes at least one support structure having a main body portion, a first insulation material generally disposed around the main body portion and a roof panel supported by the at least one support structure. A second insulation material may be disposed between the roof panel and the at least one support structure. In addition, a third insulation material may be disposed between the second insulating material and the at least one support structure. The third insulating material may be disposed a first distance apart from the roof panel and a second distance apart from the first insulation material.

In accordance with another embodiment of the present invention, an insulated roof assembly includes at least one support structure having a main body portion, a first insulation material generally disposed around the main body portion and a roof panel supported by the at least one support structure. A connector may be generally disposed between the roof panel and the at least one support structure. The connector may be in communication with the roof panel and secured to a respective at least one support structure via at least one fastener. In addition, a second insulation material may be disposed between the connector and the at least one support structure. The assembly may also include a third insulation material disposed between the connector and the second insulating material. The third insulating material may be disposed a first distance apart from the roof panel and a second distance apart from the first insulation material.

In accordance with yet another embodiment of the present invention, an insulated roof assembly includes at least one support structure having a main body portion and a top portion. A first insulation material may be generally disposed around the main body portion and above the top portion. A roof panel may be supported by the at least one support structure and a connector may be generally disposed between the roof panel and the at least one support structure. In addition, the connector may be in communication with the roof panel and secured to a respective at least one support structure via at least one fastener. A second insulation material may be disposed between the connector and the at least one support structure. The assembly may also include a third insulation material disposed between the connector and the second insulating material. The third insulating material may be disposed a first distance apart from the roof panel and a second distance apart from the first insulation material measured at a point between two at least one support structures.

DETAILED DESCRIPTION OF THE PREFERRED EMBODIMENT

Figure 2:
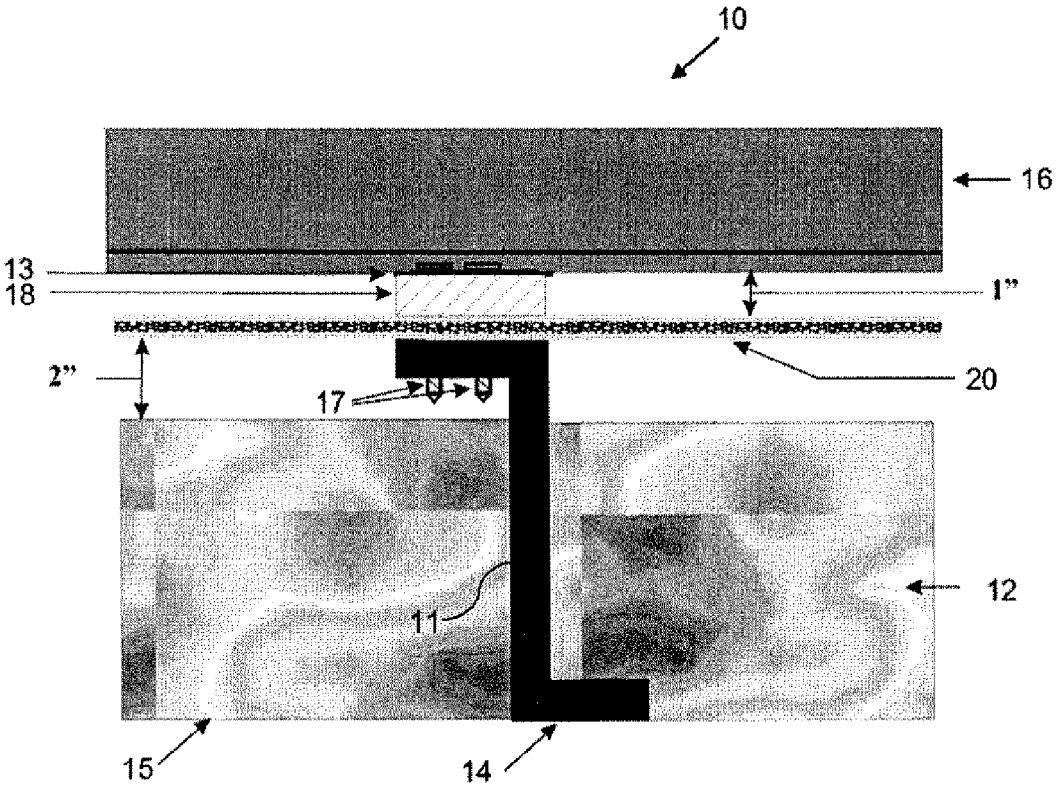
FIG. 2 is a side profile view of an insulated roof assembly in accordance with one preferred embodiment of the present invention.

FIG. 2 is a side profile view of an insulated roof assembly 10 in accordance with one preferred embodiment of the present invention. It should be noted that the insulated roof assembly in accordance with various embodiments of the present invention are described herein as applied to metal buildings with metal roofs since special unexpected advantages and synergistic effects are obtained in such applications. However, it should be noted that the present invention is not limited to such application, but can be applied to different structures, including non-metal buildings.

As can be seen in FIG. 2, the insulated roof assembly 10 includes a fiberglass insulation 12 supported by a structural support member, such as purlin 14. the structural support member, or purlin 14, also provides support to the roof panel 16. The fiberglass insulation 12 may include a vapor barrier 15 which may be attached to purlin 14. Thus, in one embodiment, the fiberglass insulation may be generally disposed around a main body portion 11 of purlin 14. Of course, other structural support members may be used for structural support, depending on the construction of the building to which the present invention is applied. The fiberglass insulation 12 has a 6 inch thickness and is rated R-19 in the illustrated example. A standing seam roof clip 13 is provided to couple the roof panel 16 to the purlin 14. Attached to the roof panel 16, the standing seam roof clip 13 is secured to the purlin 14 by fasteners 17 with a thermal foam block 18 positioned between the purlin 14 and the standing seam roof clip 13. The thermal foam block 18 in the illustrated embodiment may have an R-5 rating. The roof panel 16 is secured to the standing seam roof clip 13.

In contrast to the conventional insulated roof assembly, the insulated roof assembly 10 includes a reflective insulation 20 which is positioned at a spaced distance from the fiberglass insulation 12. Embodiments of the present invention provide continuous reflective insulation 12 uninterrupted by structural support members or framing members such as purlin 14. In the above regard, as can be seen, the reflective insulation 20 in the illustrated embodiment is positioned between the purlin 14 and the foam block 18, and is secured with minimal compression to the reflective insulation 20. The spacing between the reflective insulation 20 and the fiberglass insulation 12 is approximately 2 inches in the illustrated embodiment so that a correspondingly sized air gap is provided between these insulation layers.

In addition, the reflective insulation 20 is positioned between the thermal foam block 18 and the purlin 14. Correspondingly, the reflective insulation 20 is positioned at a spaced distance from the roof panel 16 at a distance substantially corresponding to the thickness of the thermal foam block 18, which in the illustrated embodiment, is approximately 1 inch. Thus, a correspondingly sized air gap is also provided between the reflective insulation 20, and the roof panel 16 secured thereto.

Figure 4:
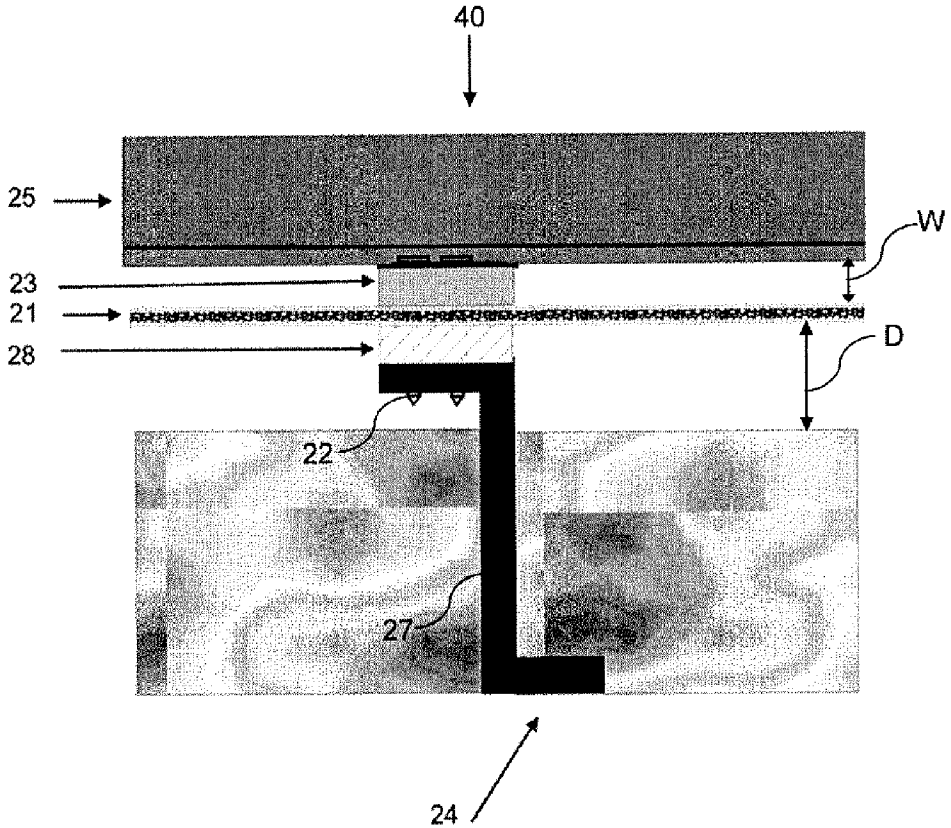
FIG. 4 is a side profile view of an insulated roof assembly in accordance with one another preferred embodiment of the present invention.

In another embodiment, as shown, for example, in FIG. 4, a roof assembly 40 includes thermal block 28 being secured directly to the purlin 24. In some embodiments, the thermal block 28 may be approximately 1 inch thick. As in the embodiment illustrated in FIG. 2, a fiberglass insulation 29 is provided generally disposed around the main body portion 27 of purlin 24. The roof assembly 40 includes a continuous reflective insulation 21 uninterrupted by structural support members or framing members such as purlin 24. A reflective insulation 21 may be disposed above the thermal block 28 and hence, a distance D away from the fiberglass insulation 29. A high profile standing seam roof clip 23 may be used to space the reflective insulation 21 a distance w away from the standing seam roof panel 25, thereby creating an airspace therebetween. In some embodiments, the aforementioned airspace may be approximately 1 inch. Attached to the standing seam roof panel 25, the seam roof clip 23 is secured to the purlin 24 by fasteners 22.

Figure 1:
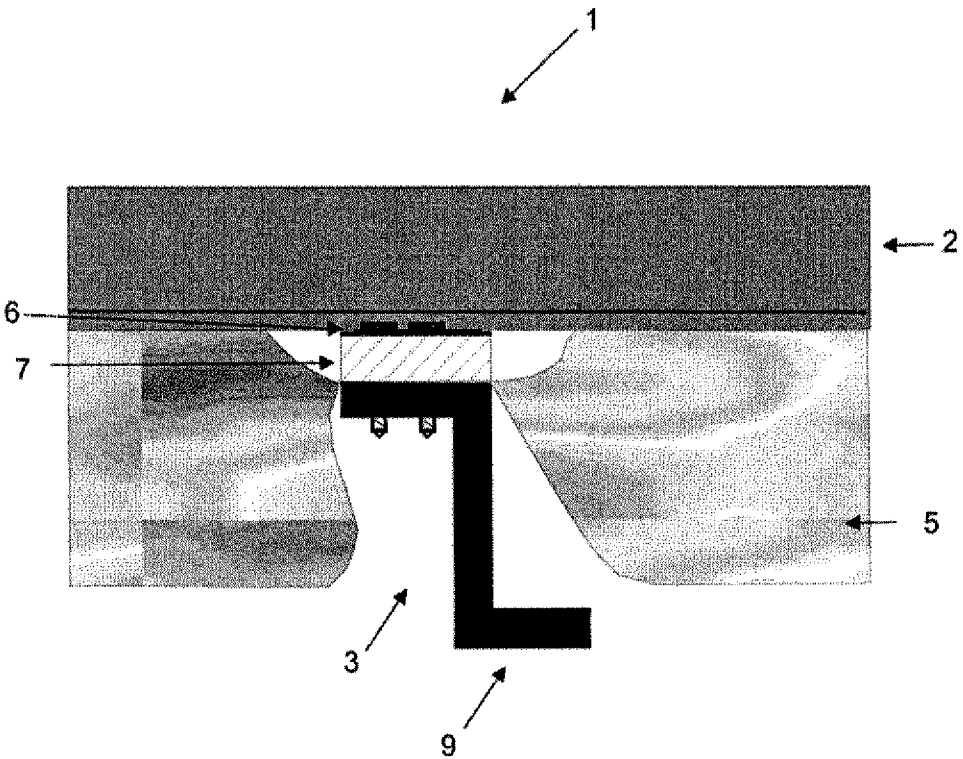
Figure 1 (Prior Art)
FIG. 1 is a side profile view of an insulated roof assembly in accordance with the prior art.

The insulated roof assembly 10 in accordance with the present invention has been found to substantially increase the insulation performance, and thus, energy efficiency, as compared to the conventional insulated roof assemblies, especially when applied to metallic roofs. More specifically, testing has shown that U-value for conventional prior art insulated roof assembly 1 as shown in FIG. 1 is U-0.065 In contrast, the U-value for the insulated roof assembly 10 as shown in FIG. 2 in accordance with the present invention was found to be approximately U-0.044 in a summer application with the reflective insulation 20. This improvement and reduction in the U-value correlates to approximately 33% increase in energy efficiency.

In addition, it has also been found that the insulated roof assembly 10 which includes the reflective insulation 20 arranged at a spaced distance from the fiberglass insulation 12 and the roof components provides superior insulation performance than merely increasing the thickness of fiberglass insulation. In this regard, by adding an R-10 layer to the R-19 fiberglass insulation so that it will fill the entire cavity, resulted in U-0.057 which is still higher than the U-0.044 attained by the insulated roof assembly 10 in accordance with the illustrated embodiment. Thus, simply increasing the thickness of the fiberglass insulation has been found to be insufficient in meeting the desired industry standards, and utilization of the reflective insulation layer in the manner of the present invention described herein was found to outperform 6 3 inches of additional fiberglass insulation. Moreover, the cost of such increases in the use of fiberglass insulation would be substantially higher than the insulated roof assembly 10 of the present invention as described herein.

Of course, the addition of the reflective insulation 20 spaced from the fiberglass insulation 12 and the roof panel 16 increases the cost of the insulated roof assembly, both from a material stand point, and installation labor stand point, as compared to the conventional insulated roof assembly as shown in FIG. 1. However, as discussed above, insulated roof assembly 10 of the present invention significantly improves the insulation effect so that energy efficiency can be improved, and meet the industry standards for metal buildings. Thus, by improving the energy performance rating, the added cost associated with implementing the insulated roof assembly 10 of the present invention over conventional roof assembly can be quickly recovered, and additional substantial cost savings can be realized over time.

Furthermore, additional synergistic benefits have been identified when the insulated roof assembly 10 of the present invention is applied to buildings that have metal roofs, for example, metal buildings. In particular, moisture from rain, ground water, humidity or other forms of condensation can pose problems in metal buildings. First, the presence of water or ice in fiberglass severely degrades the fiberglass insulation's performance, and decrease the effective service life of the insulated roof assembly. Secondly, water that is in contact with metals within the building can contribute to corrosion and decreases the service life of the metal building itself.

Thirdly, collection of water can lead to dripping, staining, and other undesirable effects such as mold, mildew and odors, which can detract from the building's intended use.

The above noted potential problems can be minimized by the insulated roof assembly 10 in accordance with one embodiment of the present invention. In particular, because the reflective insulation 20 is impermeable to water, and does not absorb any moisture, it minimizes the likelihood that water which may unintentionally enter through the roof will contact the fiberglass insulation 12. By providing an extra layer of barrier to water and moisture, corrosion to the metal building itself can be reduced. Furthermore, other undesirable effects of water and moisture such as mold, mildew and odors, can correspondingly be minimized.

It is noted that there are Standard Building Codes that may prohibit the use of a system that contains two vapor barriers. If such codes apply, then the reflective insulation must be perforated. These perforations shall be large enough to allow moisture to pass but not as large as to compromise the low emissivity of the reflective insulation.

Figure 3:
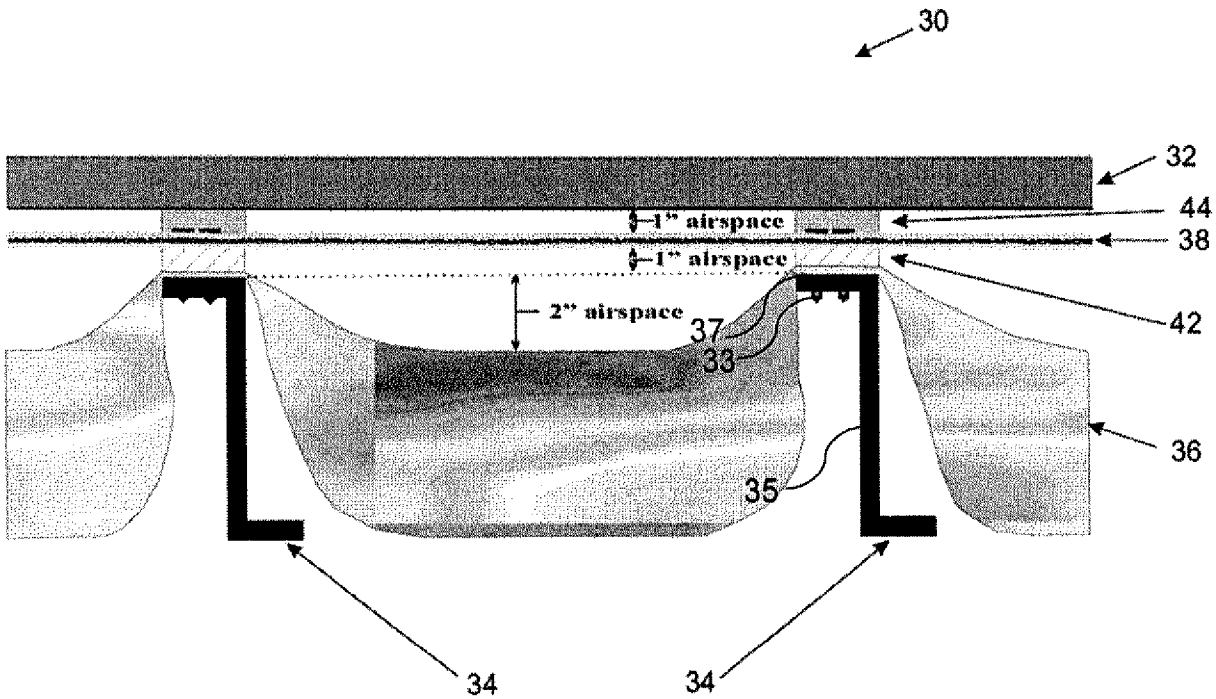
FIG. 3 is a side profile view of an insulated roof assembly in accordance with another preferred embodiment of the present invention.

FIG. 3 is a side profile view of an insulated roof assembly 30 in accordance with another preferred embodiment of the present invention. As can be seen, the insulated roof assembly 30 is configured similar to the insulated roof assembly shown in FIG. 2 discussed above. The insulated roof assembly 30 includes fiberglass insulation 36 and a continuous reflective insulation 38 uninterrupted by structural support members or framing members such as purlins 34. However, in the embodiment of FIG. 3, the fiberglass insulation 36 is draped over a top portion 37 of the purlins 34 and is secured between purlins 34 and the thermal foam blocks 42. Securing the fiberglass insulation 36 between purlins 34 may include disposing the fiberglass insulation 36 generally around a main body portion 35 of purlins 34.

The reflective insulation 38 is positioned on the thermal foam blocks 42 so that there is an air space of at least approximately 2 inches, and in the illustrated embodiment, approximately 3 inches, between the reflective insulation 38 and the fiberglass insulation 36 measured at a point between purlins 34. A high-profile standing seam roof clip 44 is provided so that in the present embodiment an air gap of approximately 1 inch is provided between the reflective insulation 38 and the roof panel 32. Attached to the roof panel 32, the seam roof clip 44 may be secured to purlin 34 via fasteners 33. Correspondingly, one air space is provided between the reflective insulation 38 and the fiberglass insulation 36, and another air space is provided between the reflective insulation 38 and the roof panel 32. The performance of the insulated roof assembly 30 shown in FIG. 3 has been found to be U-0.041 (R-24.2) in summer applications.

In addition, it has also been found that the insulated roof assembly 30 which includes the reflective insulation 38 arranged at a spaced distance from the fiberglass insulation 36 and the roof components provides superior insulation performance than merely increasing the thickness of fiberglass insulation. In this regard, by doubling the R-19 fiberglass insulation so that it is 12 inches thick resulted in U-0.046 which is worse than the U-0.041 attained by the insulated roof assembly 30 in accordance with the illustrated embodiment. Utilization of the reflective insulation layer in the manner of the present invention described herein was found to outperform 6 inches of additional fiberglass insulation. Moreover, the cost of such increases in the use of fiberglass insulation due to a time consuming and elaborate basket system would be substantially higher than the insulated roof assembly 30 of the present invention as described herein.

The reflective insulation 20, 21, 38 may be of the type described in U.S. Pat. No. 5,316,835 to Groft et al. Preferably, the reflective insulation 20, 21, 38 includes a central foam core of polyethylene, polypropylene, or the like, and is approximately 0.125 to 0.5 inch thick, preferably 0.25 inch thick. In addition, film layers that may be made of 1.0 mil lineal low density polyethylene film or equivalent, as well as reflective aluminum foil layers, are provided on both sides of the foam core of the reflective insulation 20, 21, 38. The aluminum foil layers of the reflective insulation 20, 21, 38 may be made of 0.00025 to 0.0005 inch 1100-1145, alloy A-wettable aluminum foil which has a very low emissivity or may also be a low emissivity aluminum film. Optional scrim material made of polyethylene may also be provided in the reflective insulation 20, 21, 38 for strength and to prevent damage to the various layers thereof during installation and use.

One appropriate insulation that can be used for the above described reflective insulation 20, 21, 38 is available from Environmentally Safe Products of New Oxford, Pa. under the product name Low-E™ Insulation. The reflective insulation may comprise low emittance facing material on both sides so that the air gaps above and below the reflective insulation are bounded on one side by a low emittance surface. In this regard, the reflective insulation 20, 21, 38 may be provided with a taped seam to allow sealing between adjacent reflective insulation sheets. Of course, the above described details of the reflective insulation 20, 21, 38 are merely provided as one example implementation and the present invention is not limited thereto. Other reflective insulation having various layers or construction may be used. However, the reflective insulation 20, 21, 38 must include a reflective material on at least one surface thereof, and preferably includes reflective material on both surfaces thereof.

Whereas these system U values are determined using known and accredited test facilities, it is known that there are software programs that can be used to determine these values as well. These include but are not limited to REFLECT-3 and the UK BuildDesk®. There are other programs like the ANSI/ASHRAE/IESNA Standard 90.1 ENVSTD 4.0 prepared by Eley Associates that can be used for reflective insulation. It is limited to specific insulation types, but it allows an R-11.2 for a continuous insulation uninterrupted by framing. In these systems described, the reflective insulation would not be dissimilar to that application.

Thus, the insulated roof assembly in accordance with the present invention as described above allows substantially improved energy efficiency and insulation performance which can meet the TFCC and ASHRAE Standards for metal buildings. As explained, the insulated roof assembly in accordance with the present invention provides additional R-value (or reduced U-value) over conventional insulated roof assemblies so that such standards for metal buildings can be met. Of course, the insulated roof assembly may be practiced in non-metal buildings as well. The improved energy efficiency and insulation performance are attained in an economical manner so that the additional cost associated with the insulated roof assembly can be readily recovered by the energy efficiency, and continued reduced energy cost can be realized. Furthermore, the reflective insulation has been found to provide additional synergistic advantages when used in conjunction with fiberglass insulation and/or metal buildings in that problems posed by water and other moisture can be reduced.

The following experimental data is provided to further appreciate the affect of R and U-value variations when variable thicknesses of fiberglass batt insulation and air gaps are adjusted in differing weather environments. Values including, for example, thermal performance (R-value) are generated through experimental measurements from large scale climate simulators (LSCS). The testing environment includes hybrid metal building test assemblies which utilize a layer of fiberglass blanket insulation on the lower part of the assembly with a reflective insulation system above the fiberglass and below the roof panels in accordance with disclosed embodiments of the invention. ESP reflective insulation (Low-E®) is installed above the fiberglass insulation to provide two reflective air spaces. The reflective insulation has low emittance facing material on both sides so that the air spaces above and below the reflective insulation are bounded on one side by a low emittance surface. Stand-off brackets are used to hold the roof panels above the purlins and provide space for a reflective air space above the Low-E® insulation.

Boundary Conditions for the Tests

Thermal measurements include data for both heat flow up and heat flow down situations. The thermal boundary conditions for the test are shown in Table 1.

TABLE 1

Thermal Boundary Conditions in ° F.

| Season | Interior Temperature | Exterior Temperature | Heat Flow Direction |
|---|---|---|---|
| Summer | 70 | 110 | Down |
| Winter | 70 | 30 | Up |

Material Properties

A ¼-inch thick of Low-E® reflective insulation is utilized having an R-value 1 ft2·h·° F./Btu. The hemispherical emittance of the facers is 0.03 as determined with ASTM C 1371. Since the fiberglass batt insulation represents a significant part of the assemblies being tested, the thermal resistance (R-value) of the insulation is measured as a function of density and temperature using ASTM C 518. The results of the thermal tests are given in Table 2 for the fiberglass batt insulation and Table 3 for the single test done on the reflective insulation.

TABLE 2

Measured Properties of the Fiberglass Batt Insulation

| Specimen Density ($lb_m/ft^3$) | Thickness (inches) | Ave. Temp. (° F.) | k (Btu · in./ $ft^2$ · hr · ° F.) | R* (R/in.) ($ft^2$ · hr · ° F./ Btu · in.) |
|---|---|---|---|---|
| 1.03 | 3.50 | 75.0 | 0.2598 | 3.85 |
| 0.90 | 4.00 | 75.0 | 0.2702 | 3.70 |
| 0.80 | 4.50 | 75.0 | 0.2831 | 3.53 |
| 0.72 | 5.00 | 75.0 | 0.2965 | 3.37 |
| 1.03 | 3.50 | 35.0 | 0.2317 | 4.32 |
| 0.80 | 4.50 | 35.0 | 0.2504 | 3.99 |
| 0.72 | 5.00 | 35.0 | 0.2609 | 3.83 |
| 1.03 | 3.50 | 115.0 | 0.2915 | 3.43 |
| 0.80 | 4.50 | 115.0 | 0.3202 | 3.12 |
| 0.72 | 5.00 | 115.0 | 0.3357 | 2.98 |

TABLE 3

Measured Properties for Specimen of Low-E ® Reflective Insulation

| Specimen Density ($lb_m/ft^3$) | Thickness (inches) | Ave. Temp. (° F.) | k (Btu · in./ $ft^2$ · h · ° F.) | Material R ($ft^2$ · h · ° F./Btu) |
|---|---|---|---|---|
| 2.0 | 0.235 | 75.0 | 0.2334 | 0.99 |

The R-per-inch of thickness of the fiberglass batt insulation in Table 2 is described by Equation (1) as a function of temperature and density to better than +/−1%.

$$R=1.01(0.060739+0.064802*\rho+0.13622/\rho+(0.001354-0.000591*\rho)*(T-75) \quad (1)$$

Insulation Assemblies that were Tested

The two hybrid insulation assemblies being tested in the LSCS consist of nominal R-19 fiberglass insulation installed either over or between the purlins. The purlins are mounted 60 inches on center. One-inch thick polystyrene thermal blocks are placed above the purlins. Metal brackets above the thermal breaks are used to hold the standing seam roof above the horizontal layer of Low-E® reflective insulation. The result is an assembly with two reflective air spaces above the conventional fiberglass insulation. The upper reflective air space (roof panel to Low-E®) is 1.5 to 2.5 inches across. The lower reflective air space (Low-E® to fiberglass batt) is 2.5 to 4.5 inches across. System One contains fiberglass insulation perpendicular to the purlins. System Two has fiberglass insulation installed over the purlins.

Table 4 contains measured values for the air space thicknesses and insulation thicknesses for the two hybrid assemblies. The table also contains the density and the average test temperature for the fiberglass baits during the tests.

TABLE 4

Temperature and Thickness Data

| Element | Thickness (in.) | Density ($lb_m/ft^3$) | $T_{mean}$ (Summer Condition) (° F.) | $T_{mean}$ (Winter Condition) (° F.) |
|---|---|---|---|---|
| System One | | | | |
| Upper air space | 2.48 | n/a | 99.4 | 37.2 |
| Lower air space | 4.38 | n/a | 97.4 | 39.5 |
| Fiberglass batt | 4.15 | 0.87 | 79.2 | 57.2 |
| System Two | | | | |
| Upper air space | 1.47 | n/a | 100.6 | 36.2 |
| Lower air space | 3.38 | n/a | 98.8 | 38.1 |
| Fiberglass batt | 5.07 | 0.71 | 80.6 | 56.1 |

The thickness, density, and temperature data in Table 4 is used to calculate the in-situ R-value of the fiberglass batt in each of the four tests. The nominal R-value for the batt insulation is 19. The last column in Table 4 is a ratio of the in-situ R to the nominal R expressed as a percentage.

TABLE 5

In-situ R for the Fiberglass Components in Four LSCS Tests

| Test Identification | In-situ R ($ft^2$ · hr · ° F./Btu) | Nominal R ($ft^2$ · hr · ° F./Btu) | Ratio (%) |
|---|---|---|---|
| System 1 - winter | 16.04 | 19 | 84 |
| - summer | 15.21 | 19 | 80 |

TABLE 5-continued

| In-situ R for the Fiberglass Components in Four LSCS Tests | | | |
|---|---|---|---|
| Test Identification | In-situ R ($ft^2 \cdot hr \cdot ° F./Btu$) | Nominal R ($ft^2 \cdot hr \cdot ° F./Btu$) | Ratio (%) |
| System 2 - winter | 18.04 | 19 | 95 |
| - summer | 16.69 | 19 | 88 |

Thermal Resistance Results for the Two Hybrid Systems

The primary measurements from the LSCS tests are the steady-state heat flow through a 64 $ft^2$ test specimen and the temperature difference across the test specimen. Equation (1) is used to calculate the R-value from the measured values. The measured heat flow (and heat flux) is an average value over the area of the test specimen. The measured heat flux, therefore, includes the heat flow through the purlins as well as the heat flow through the insulated region between the purlins. The exterior air film resistances can be determined from the measurements, since the heat flux at the surface is the same as the heat flux through the test assembly. Thermal sensors provide the temperature difference between the surface and the adjacent air. Application of Equation (1) then gives measured values for the air film resistances. Air film resistances taken from the ASHRAE Handbook of Fundamentals are used to calculate the air-to-air R-values and U-values for a field application. This is done, because the film coefficients in a test apparatus can differ from those present in a full-scale building application. Table 6 contains measured surface-to-surface R-values for the hybrid assemblies that were tested. Air-to-air R-values are listed in Table 6 for both measured R-values and published air film coefficients. The results are for a typical element of roof assembly with purlins that are five feet on center. The published air-film coefficients that were used are shown in the table. R-values are given with units $ft^2 \cdot h \cdot ° F./Btu$ while U-values are given with units $Btu/ft^2 \cdot h \cdot ° F$.

TABLE 6

| R-values and U-values for Four Sets of LSCS Data | | | | |
|---|---|---|---|---|
| | System One | | System Two | |
| Property | Summer | Winter | Summer | Winter |
| R surface-to-surface | 21.4 | 17.9 | 23.2 | 21.0 |
| Measured Air Film | 0.86 | 0.96 | 1.03 | 1.11 |
| R air-to-air | 22.3 | 18.9 | 24.2 | 22.1 |
| U-value | 0.045 | 0.053 | 0.041 | 0.045 |
| Published Air Film | 1.17 | 0.78 | 1.17 | 0.78 |
| R air-to-air | 22.6 | 18.7 | 24.4 | 21.7 |
| U-value | 0.044 | 0.053 | 0.041 | 0.046 |

An analysis of the insulation between the purlins for the four hybrid systems in this project is contained in Table 7. In each case, average thicknesses are used at four representative locations to calculate the thermal contribution of each layer. Measured values for the materials and calculated values for the reflective air space are used. The R-values in Table 6 do not include the heat flow through the purlins. These results provide a measure of the reflective insulation system to the performance of the hybrid system between the purlins. The ratio of the R-value for the region between the purlins to the measured surface-to-surface R-values shows the effect of the purlins.

TABLE 7

| Calculated Thermal Resistances for the Region Between Purlins | | | | |
|---|---|---|---|---|
| | System One | | System Two | |
| R-value for Element | Summer | Winter | Summer | Winter |
| Upper Ref Air Space | 7.73 | 3.01 | 5.57 | 2.95 |
| Low-E ® | 0.99 | 0.99 | 0.99 | 0.99 |
| Lower Ref Air Space | 9.69 | 3.22 | 8.61 | 3.21 |
| Total Ref Contribution | 18.41 | 7.22 | 15.17 | 7.15 |
| Fiberglass Contribution | 15.21 | 16.03 | 16.69 | 18.04 |
| Total R | 33.62 | 23.25 | 31.86 | 25.19 |
| Reflective Insulation Contribution to Total R | 55% | 31% | 48% | 28% |

The measured surface-to-surface R-values are compared in Table 8 with the calculated R-values for the region between purlins. This comparison provides some insight into the effect of the purlins on the overall heat flow through the assembly. A large value for the ratio is desired, because this ratio means that the heat flow through the purlins is not dominating the overall heat flow.

TABLE 8

| Comparison of Overall R-value with Between Purlins R-value | | | |
|---|---|---|---|
| | Surface-to-Surface R-values | | Ratio |
| Test Identification | Measured | Calculated | (Measured/Calculated) |
| System 1 - winter | 17.9 | 23.3 | 77% |
| System 1 - summer | 21.4 | 33.6 | 64% |
| System 2 - winter | 21.0 | 25.2 | 83% |
| System 2 - summer | 23.2 | 31.9 | 73% |

SUMMARY

The measured U-values in Table 6 indicate that the hybrid systems exceed the current ASHRAE Standard 90.1 requirements in all climate zones 1-7 for both winter and summer conditions. The U-values based on the ASHRAE Handbook values for the air film resistances agree with U-values based on the measured air film coefficients. The in-situ R-values for both draped fiberglass and the fiberglass installed between purlins is less than the nominal value of R 19 for both winter and summer conditions. The shortfall in the fiberglass R-value is due to the reduced thickness. The reflective part of the hybrid system contributed between 28 and 55% of the total surface-to-surface R-value. The reflective part of the hybrid system is more effective in the summer than in the winter. The draped fiberglass bats yielded better performance than the Batts installed perpendicular to the purlins. This appears to be the result of a small increase in the thermal resistance in the path of the purlins.

While various embodiments in accordance with the present invention have been shown and described, it is understood that the invention is not limited thereto. For example, all of the material thicknesses discussed herein may be adjusted, for example, to alter air gaps as desired to achieve desired U-values for specific applications. The values and thicknesses described herein are for illustrative purposes and examples and should not be construed as limiting the invention. The present invention may be changed, modified and further applied by those skilled in the art. Therefore, this invention is not limited to the detail shown and described previously, but also includes all such changes and modifications.

I claim:

1. An insulated roof assembly comprising:

at least one support structure having a main body portion;

a first insulation material generally disposed around said main body portion;

a roof panel supported by said at least one support structure;

a second insulation material disposed between said roof panel and said at least one support structure; and a reflective insulation material disposed between said second insulating material and said at least one support structure, said reflective insulating material being separated from said roof panel by a first air gap of at least approximately 1 inch, and said reflective insulating material being separated from said first insulation material by a second air gap of at least approximately 1 inch.

2. The assembly of claim 1, further comprising:

a connector generally disposed between the roof panel and the second insulating material, said connector in communication with the roof panel and secured to a respective said at least one support structure via at least one fastener.

3. The assembly of claim 1, wherein said at least one support structure comprises at least two support structures.

4. The assembly of claim 3, wherein the first air gap is contained between the at least two support structures.

5. The assembly of claim 3, wherein the second air gap is contained between the at least two support structures.

6. The assembly of claim 1, wherein the first insulation material is approximately 6 inches thick having an R-19 rating, the second insulation material is approximately 1 inch thick having an R-5 rating, and the reflective insulation material is approximately 0.125 to 0.5 inches thick.

7. The assembly of claim 1, wherein the U-value is approximately 0.044.

8. The assembly of claim 2, wherein the connector comprises:

a seam roof clip.

9. The assembly of claim 1, wherein the at least one support structure comprises:

at least one purlin.

10. The assembly of claim 1, wherein the first insulating material is fiberglass insulation, and the second insulating material is a thermal foam block.

11. The assembly of claim 1, wherein the first air gap is differently dimensioned from the second air gap.

12. The assembly of claim 1, wherein the reflective insulation material is continuous and uninterrupted by said at least one support structure.

13. An insulated roof assembly comprising:

at least one support structure having a main body portion;

a first insulation material generally disposed around said main body portion;

a roof panel supported by said at least one support structure;

a connector generally disposed between the roof panel and the at least one support structure, said connector in communication with the roof panel and secured to a respective said at least one support structure via at least one fastener;

a second insulation material disposed between said connector and said at least one support structure; and a reflective insulation material disposed between said connector and said second insulating material, said reflective insulating material being separated from said roof panel by a first air gap of at least approximately 1 inch and from said first insulation material by a second air gap air gap of at least approximately 1 inch.

14. The assembly of claim 13, wherein said at least one support structure comprises at least two support structures.

15. The assembly of claim 14, wherein the first air gap is contained between the at least two support structures.

16. The assembly of claim 14, wherein the second air gap is contained between the at least two support structures.

17. The assembly of claim 13, wherein the connector comprises:

a seam roof clip.

18. The assembly of claim 13, wherein the at least one support structure comprises:

at least one purlin.

19. The assembly of claim 13, wherein the first insulating material is fiberglass insulation, and the second insulating material is a thermal foam block.

20. The assembly of claim 13, wherein the reflective insulation material is continuous and uninterrupted by said at least one support structure.

21. An insulated roof assembly comprising:

at least two support structures, each support structure having a main body portion and a top portion;

a first insulation material generally disposed around said main body portion and above the top portion of the at least two support structures;

a roof panel supported by said at least two support structures;

a connector generally disposed between the roof panel and each support structure, said connector in communication with the roof panel and secured to a said respective support structure via at least one fastener;

a second insulation material disposed between said connectors and said at least two support structures; and a reflective insulation material disposed between said connectors and said second insulating material, said reflective insulating material being separated from said roof panel by a first air gap of at least approximately 1 inch and from said first insulation material by a second air gap of at least approximately 1 inch measured at a point between said at least two support structures.

22. The assembly of claim 21, wherein the first air gap is approximately 1 inch thick, and the second air gap is approximately 3 inches thick.

23. The assembly of claim 21, wherein the connector comprises:

a seam roof clip.

24. The assembly of claim 21, wherein the at least one support structure comprises:

at least one purlin.

25. The assembly of claim 21, wherein the first insulating material is fiberglass insulation, and the second insulating material is a thermal foam block.

26. The assembly of claim 21, wherein the U-value is approximately 0.041.

27. The assembly of claim 21, wherein the first air gap is differently dimensioned from the second air gap.

28. The assembly of claim 21, wherein the reflective insulation material is continuous and uninterrupted by said at least two support structures.

* * * * *